United States Patent [19]

Ohira et al.

[11] Patent Number: 4,908,660

[45] Date of Patent: Mar. 13, 1990

[54] IMAGE DUPLICATING APPARATUS HAVING COMPOSITE AND DUPLEX MODES OF OPERATION

[75] Inventors: Tadashi Ohira; Syuzi Maruta, both of Osaka, Japan

[73] Assignee: Minolta Camera Kabushiki Kaisha, Osaka, Japan

[21] Appl. No.: 171,887

[22] Filed: Mar. 22, 1988

[30] Foreign Application Priority Data

Mar. 23, 1987 [JP] Japan ..... 62-68670

[51] Int. Cl.[4] ..... G03G 21/00

[52] U.S. Cl. ..... 355/206; 355/308; 355/319

[58] Field of Search ..... 355/14 R, 14 SH, 14 CU, 355/23, 24, 25, 26, 203, 205, 206, 308, 316, 319; 271/127, 166, 258, 259, 263, 176

[56] References Cited

U.S. PATENT DOCUMENTS

| | | | |
|---|---|---|---|
| 4,076,408 | 2/1978 | Reid et al. | 355/14 SH |
| 4,210,319 | 7/1980 | Hynes | 271/166 X |
| 4,702,589 | 10/1987 | Ito . | |

FOREIGN PATENT DOCUMENTS

| | | | |
|---|---|---|---|
| 56-17361 | 2/1981 | Japan . | |
| 56105249 | 6/1983 | Japan | 355/14 SH |
| 60-214374 | 10/1985 | Japan | 355/26 |
| 60-218667 | 11/1985 | Japan | 355/26 |
| 62-9367 | 1/1987 | Japan . | |

*Primary Examiner*—A. T. Grimley
*Assistant Examiner*—Edward J. Pipala
*Attorney, Agent, or Firm*—Burns, Doane, Swecker & Mathis

[57] ABSTRACT

An image duplicating apparatus has a mode of copying operation of two consecutive cycles and includes an image duplicator module for reproducing on a copying sheet a visible image duplicated from an original image on a document sheet. A document feed module for automatically feeding a document sheet to and from a position enabling the image duplicator module to reproduce the visible image on a copying sheet is included as is a paper recirculation unit for receiving from the image duplicator module the copying sheet on which the visible image has been reproduced during an earlier cycle of copying operation. The paper recirculation unit is operative to recirculate the copying sheet towards the image duplicator module during the later cycle of copying operation. Any difference is detected between the number of copying sheets received by the paper recirculation unit during the earlier cycle of copying operation and the number of copying sheets recirculated from the paper recirculation unit during the latter cycle of copying operation so as to produce a signal when the difference is detected upon completion of two consecutive cycles of copying operation. In response to such a signal, the document feed module may be disabled from feeding a document sheet to the position enabling the image duplicator module to reproduce the visible image on a copying sheet.

18 Claims, 10 Drawing Sheets

COMPOSITE MODE

DUPLEX MODE

IMAGE DUPLICATING APPARATUS HAVING COMPOSITE AND DUPLEX MODES OF OPERATION

FIELD OF THE INVENTION

The present invention relates to an image duplicating apparatus and particularly to an image duplicating apparatus such as a copying apparatus of the type having a multiplicity of modes of operation including composite and duplex modes of copying operation.

BACKGROUND OF THE INVENTION

Recent versions of copying apparatus have various extra capabilities including those for a composite mode of operation and a duplex mode of operation. As well known in the art, a composite mode of copying operation is used for the purpose that images within two different specified areas of a document or images on different document sheets are duplicated in two successive cycles of operation on a single face of a single copying sheet. In a duplex mode of copying operation, images within two different specified areas of a document or images on different document sheets is duplicated in two successive cycles of operation on the opposite faces, respectively, of a single copying sheet.

During a composite or duplex mode of copying operation, a copying sheet having reproduced images already printed on one side thereof at the image reproducing stage of the apparatus is, after being turned out or not turned out passed to a paper recirculation unit for temporary storage therein. From the paper recirculation unit, the copying sheet is for a second time supplied to the image reproducing stage so that reproduced images are further printed on the previously printed face of the sheet or on the reverse face of the sheet.

In the process of such copying operation, it may happen that two or even more copying sheets are fed to the image reproducing stage of the apparatus during the earlier or "first" half cycle of the two consecutive cycles of composite or duplex mode of operation. Reproduced images are printed on one face of one these two or more copying sheets, which are then passed over to the paper recirculation unit. It is, in this instance, likely that, among the copying sheets thus stored temporarily, only one of them is supplied from the paper recirculation unit during the later or "second" half cycle of the composite or duplex mode of operation. The result that the remaining one or more copying sheets, which may all consist of plain or non-printed sheets or may include a single printed sheet, are left in the paper recirculation unit without being discharged out of the paper recirculation unit.

There may also be a case where two or even more of the copying sheets passed to and stored in the paper recirculation unit are picked up and recirculated from the paper recirculation unit during the "second" half cycle of the composite or duplex mode of operation.

An occurrence of such a "double feed" of copying sheets would result in failure in executing a composite or duplex mode of operation. To preclude an occurrence of double feed of copying sheets, an image duplicating apparatus using a double feed sensor to detect a stack of two or more copying sheets from a beam of light reflected from or transmitted through the stack of paper. An example of the sensor using reflected light is taught in Japanese Provisional Patent Publication (Kokai) No. 58-07655 and an example of the sensor using reflected light is taught in Japanese Provisional Patent Publication (Kokai) No. 58-31353. The double feed sensor of the former type is arranged to detect an occurrence of double feed in respect of the copying sheets to be fed to the image reproducing stage of the apparatus and is for this reason useless for the detection of double feed from the paper recirculation unit. The double feed sensor of the latter type has a drawback in that the signal resulting from the light transmitted through a sheet or sheets of paper could not discriminate between printed and non-printed sheets.

The present invention contemplates the provision of an improved image duplicating apparatus which will overcome these difficulties thus far experienced in a prior-art image duplicating apparatus the type having composite and duplex modes of operation.

It is accordingly a prime object of the present invention to provide an image duplicating apparatus which features means operative to detect if the number of printed outputs produced by the end of the copying operation for a given document sheet equals the total number of prints initially selected and entered by the operator for composite and duplex modes of operation.

SUMMARY OF THE INVENTION

In accordance with one outstanding aspect of the present invention, there is provided an image duplicating apparatus comprising an image duplicating apparatus having a mode of copying operation consisting of two consecutive cycles, comprising (a) image reproducing means for reproducing on a copying sheet a visible image duplicated from an original image on a document sheet, (b) document feed means for automatically feeding a document sheet to and from a position enabling the image reproducing means to reproducing the visible image on a copying sheet, (c) paper recirculation means for receiving from the image reproducing means the copying sheet on which the visible image has been reproduced during the earlier half cycle of copying operation, the paper recirculation means being operative to recirculate the copying sheet toward the image reproducing means during the later half cycle of copying operation, (d) means for detecting a difference between the number of copying sheets received by the paper recirculation means during the earlier half cycle of copying operation and the number of copying sheets recirculated from the paper recirculation means during the later half cycle of copying operation for producing a signal when the difference is detected upon completion of the two consecutive cycles of copying operation, and (e) control means responsive to the signal for disabling the document feed means from feeding a document sheet to the position enabling the image duplicator module to reproducing the visible image on a copying sheet.

In accordance with another outstanding aspect of the present invention, there is provided an image duplicating apparatus having a mode of copying operation consisting of two consecutive cycles, comprising (a) image reproducing means for reproducing on a copying sheet a visible image duplicated from an original image on a document sheet, (b) paper recirculation means for receiving from the image reproducing means the copying sheet on which the visible image has been reproduced during the earlier half cycle of copying operation, the paper recirculation means being operative to recirculate the copying sheet toward the image reproducing means during the later half cycle of copying operation, and (c) means for detecting a difference between the number of copying sheets received by the paper recirculation means during the earlier half cycle of copying operation and the number of copying sheets recirculated from the paper recirculation means during the later half cycle of copying operation for producing a warning signal when the difference is detected upon completion of the two consecutive cycles of copying operation.

In accordance with still another outstanding aspect of the present invention, there is provided an image duplicating apparatus having a mode of copying operation consisting of two consecutive cycles, comprising (a) image reproducing means for reproducing on a copying sheet a visible image duplicated from an original image on a document sheet, (b) paper recirculation means for receiving from the image reproducing means the copying sheet on which the visible image has been reproduced during the earlier half cycle of copying operation, the paper recirculation means being operative to recirculate the copying sheet toward the image reproducing means during the later half cycle of copying operation, (c) means for detecting the number of copying sheets received by the paper recirculation means during the earlier half cycle of copying operation and the number of copying sheets recirculated from the paper recirculation means during the later half cycle of copying operation, and (d) means for discharging a copying sheet or sheets out of the paper recirculation means upon completion of the two consecutive cycles of copying operation when it is detected that the number of copying sheets received by the paper recirculation means during the earlier half cycle of copying operation is larger than the number of copying sheets recirculated from the paper recirculation means during the later half cycle of copying operation.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

Figure 1A:
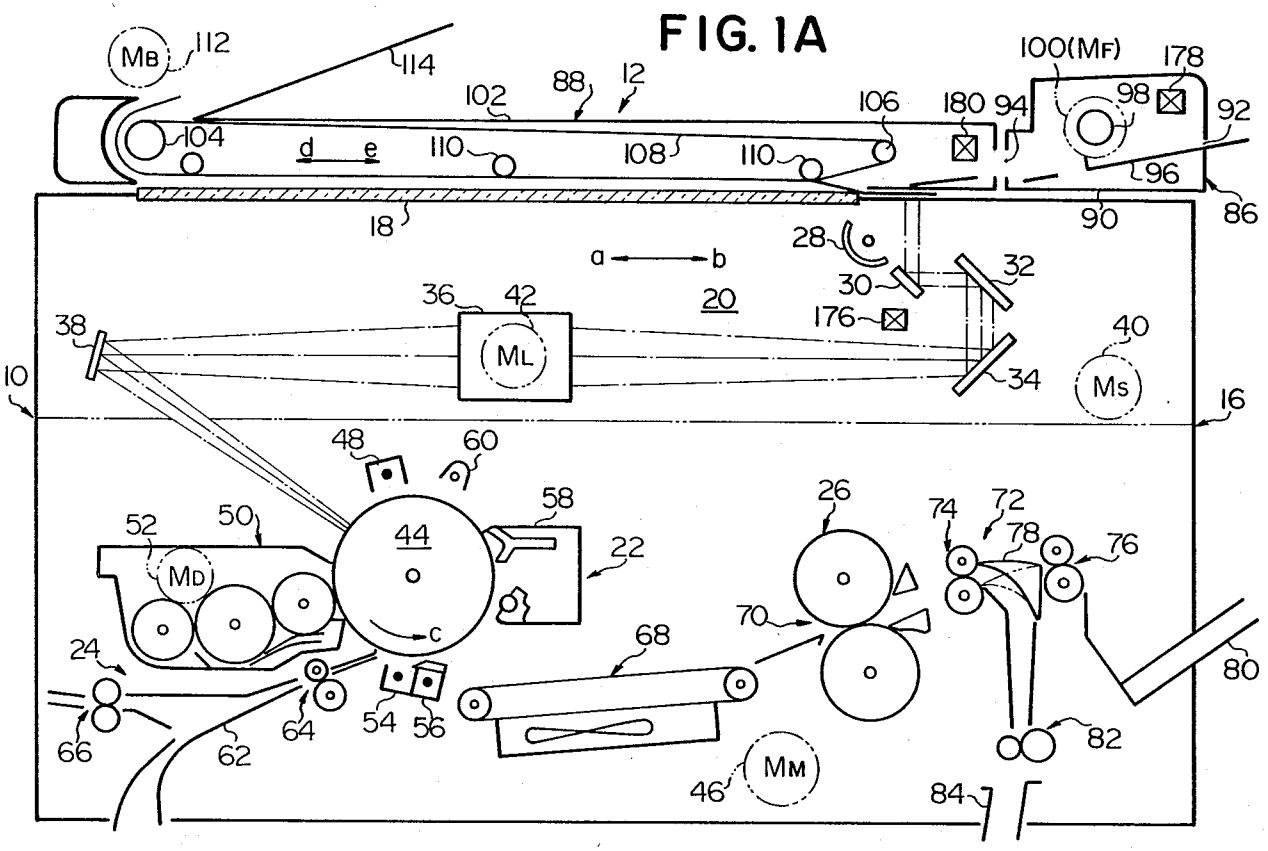
FIGS. 1A and 1B are side elevation views showing the general mechanical construction and arrangement of a preferred embodiment of an image duplicating apparatus according to the present invention.
Figure 1B:
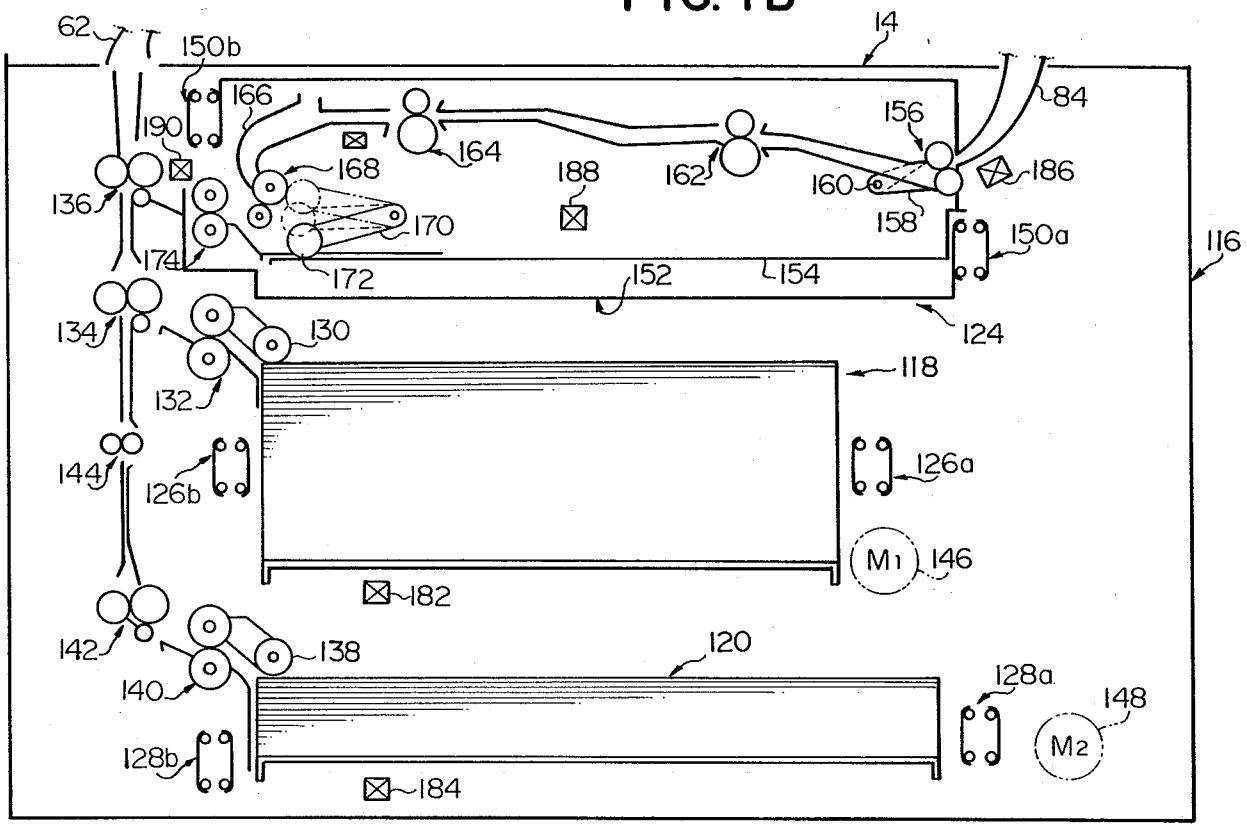

A preferred embodiment of an automated image duplicating apparatus according to the present invention will be hereinafter described with reference to the drawings, first particularly to FIGS. 1A and 1B which show the general mechanical construction and arrangement of such an embodiment. As shown in FIG. 1, the image duplicating apparatus embodying the present invention largely consists of a main module implemented by an electrophotographic duplicator module 10, a first optional or subsidiary module implemented by an automatic document feed module 12 positioned atop the duplicator module 10, and a second optional or subsidiary module implemented by a paper supply module 14 positioned below the duplicator module 10. The duplicator module 10 and automatic document feed module 12 are illustrated in FIG. 1A, while paper supply module 14 illustrated in FIG. 1B.

Duplicator Module (Main Module)

The duplicator module 10 implementing the main module of the apparatus embodying the present invention has a housing structure 16 including an upper panel portion which is in part provided by a transparent document support table 18. A sheet of document bearing images to be reproduced is to be placed on this document support table 18.

The duplicator module 10 further comprises an optical scanning system 20, an image reproducing system 22, a paper feed mechanism 24 and an image fixing assembly 26. The optical scanning system 20 comprises a light exposure lamp 28 from which a beam of light is incident on and reflected from the lower face of the document sheet on the document support table 18. The reflected light is downwardly incident onto an object mirror 30 and is re-directed rearwardly. The exposure lamp 28 and object mirror 30 are movable together along the document support table 18 as indicated by arrows a and b.

The light reflected by the object mirror 30 is redirected toward a mirror 32, which further re-directs the light downwardly toward another mirror 34. The mirrors 32 and 34 are also movable along the document support table 18 into and out of predetermined home positions indicated by full lines. From the mirror 34, the light travels forwardly along the document support table 18 and is passed through an image magnification/reduction lens unit 36 (hereinafter referred to as magnification lens unit) to a projecting mirror 38. The lens unit 36 is movable along the document support table 18 independently of the exposure lamp 28 and mirrors 30, 32 and 34 with respect to the table 18. Movement of the lens unit 36 in either direction with respect to the mirror 38 results in a change in the ratio of magnification or reduction (hereinafter referred to simply as magnification) of the images to be reproduced. The exposure lamp 28 and mirror 30 are operatively coupled to common drive means and travel at a speed doubling the speed of movement of the mirrors 32 and 34. Such drive means is assumed to include a d.c. scanner drive motor 40 ($M_S$). The lens unit 36 is also operatively coupled to appropriate drive means, which is assumed to include a pulse-driven stepper motor 42 herein referred to as lens drive motor ($M_L$). It is herein further assumed that the lamp 28 and object mirror 30 implement, in combination, a document scanner 28/30 in the scanning system 20. The document scanner 28/30 has, with respect to the document support table 18, a predetermined home position which corresponds to one end of the table 18.

The image reproducing system 22 comprises a cylindrical image transfer drum 44 having a conductive peripheral surface layer coated with a photoconductive substance. The light incident on the image reproducing system 22 is re-directed toward this image transfer drum 44 and is focused onto the peripheral surface of the drum 44. The image transfer drum 44 is driven for rotation in a direction indicated by arrow c by appropriate drive means, which is assumed to include a main drive motor 46 ($M_M$). The exposure lamp 28 and mirror 30 and the mirrors 32 and 34 are driven for movement at speeds proportional to the peripheral speed (V) of rotation of the image transfer drum 44. On the other hand, a change in the position of the lens unit 36 with respect to the peripheral surface of the image transfer drum 44 results in a change in the magnification/reduction ratio (N) of the images to be reproduced. In the embodiment herein shown, it is assumed that the exposure lamp 28 and mirror 30 are driven for movement at a speed V/N and the mirrors 32 and 34 at a speed V/2N.

The image reproducing system 22 further comprises a main charger 48 to sensitize the photoconductive peripheral surface of the image transfer drum 44 by applying electrostatic charges uniformly to the surface of the drum 44. These charges are dissipated in areas exposed to light and electrostatic latent images are created by the charges remaining on the image transfer drum 44 upon irradiation with light from the mirror 38. Posterior to the path of light to the image transfer drum 44 is located an image developing unit 50 having a stock of toner particles to be applied to the photoconductive peripheral surface of the drum 44. Visible toner images are thus produced conformingly to the latent images on the image transfer drum 44. The image developing unit 50 has a develop motor 52 ($M_D$) incorporated therein.

Posterior to the image developing unit 50 in turn is pro- vided an image transfer charger 54 which is operative to apply electrostatic charges to a copying sheet so that the toner images on the image transfer drum 44 are transferred to the copying sheet. The copying sheet thus having the toner images carried thereon is cleared of charges by a separation charger 56 located posterior to the image transfer charger 54. There is further provided a drum cleaner unit 58 which removes any residual toner particles from the peripheral surface of the image transfer drum 44. Posterior to this cleaner unit 58 in turn is positioned a charge eraser lamp 60 which irradiates the cleaned peripheral surface of image transfer drum 44 to eliminate the charges which may be left thereon. Though not shown, each of the chargers 48, 54 and 56, developing and cleaner units 50 and 58 and eraser lamps 60 and 56 includes or is associated with appropriate drive or actuator means.

The paper feed mechanism 24 is provided to feed a copying sheet to image transfer drum 44 and comprises a passage member 62 extending from the bottom of the housing structure 16 upwardly toward the drum 44. In the vicinity of the leading end of the passage member 62 and posterior to the developing unit 50 is positioned a pair of timing rollers 64 which are held in rollable contact with each other. A copying sheet passed from the passage member 62 is passed through the timing rollers 64 to image transfer drum 44 at a timing synchronized with the movement of the document scanner 28/30. The passage member 62 is adapted to feed a copying sheet upwardly into the duplicator module 10 from the paper supply module 14. During duplex mode of copying operation, a copying sheet having images printed on one side thereof and turned out within the paper supply module 14 is passed back into the duplicator module 10 of the apparatus for printing on the other side thereof as will described in more detail. The paper feed mechanism 24 is herein assumed to further comprises a pair of guide rollers 66 provided in association with a slot formed in the housing structure 16 of the duplicator module 10. The slot forms part of a manual paper feed stage (not shown) adapted to guide a manually supplied copying sheet to travel through a portion of the passage member 62 to the timing rollers 64 and past the timing rollers 64 to image transfer drum 44. The timing roller pair 64 and guide roller pair 66 as well as the image transfer drum 44 thus provided within the duplicator module 10 of the apparatus are operatively connected to the main drive motor 46 through actuator means including solenoid-operated clutches (not shown).

The paper feed mechanism 24 further comprises a copysheet transport belt assembly 68 positioned posterior to the area where the copying sheet is to be separated from the image transfer drum 44. The transport belt assembly 68 comprises spaced driven and idler rollers and an endless transport belt passed between the rollers.

The image fixing assembly 26 is provided at the rear of the transport belt assembly 68 and comprises a pair of heater rollers 70 arranged to form therebetween a nip aligned with the path of travel of a copy sheet from the belt assembly 68. The copy sheet transported on the transport belt assembly 68 is thus nipped between the heater rollers 70 so that the toner particles carried on the sheet are thermally fused and the toner images are fixed on the copy sheet.

Past the belt assembly 68 is provided a shifter assembly 72 which comprises a first pair of guide rollers 74 positioned immediately posterior to the heater rollers 70 and a second pair of guide rollers 76 spaced apart forwardly from the guide roller pair 74 in the direction of travel of a copy sheet from the image fixing assembly 26. Between the first and second guide roller pairs 74 and 76 is provided a rockable two-way guide member 78 which is rockable between an angular position to pass a copy sheet from the first pair of rollers 74 to the second pair of guide rollers 76 as indicated by broken lines and an angular position to pass a copy sheet downwardly from the first pair of guide rollers 74 as indicated by full lines. The copy sheet passed to the second pair of guide rollers 76 through the two-way guide member 78 is withdrawn to a paper collect tray 80 and a discharge slot provided in the housing structure 16.

On the other hand, the copy sheet downwardly from the first pair of guide rollers 74 is passed through a pair of guide rollers 82 to a passageway 84 extending downwardly from the duplicator module 10 into the paper supply module 14. Though not shown, the shifter assembly 72 is provided with an actuator which when activated drives the two-way guide member 78 to move to the angular position to direct a copy sheet toward the second pair of guide rollers 76 and an actuator which when activated drives the guide member 78 to move to the angular position to direct the copy sheet toward the passageway 84.

Automatic Document Feed (ADF) Module (First Subsidiary Module)

The automatic document feed module 12 implementing the first subsidiary module of the apparatus embodying the present invention largely comprises a document supply unit 86 and a document transport unit 88 which are arranged horizontally in a direction of forward advancement of document sheet as indicated by arrow d. The document supply unit 86 comprises a housing 90 having inlet and outlet slots 92 and 94, a document supply tray 96 extending into the housing 90 through the inlet slot 92, and a document feed roller 98 positioned on top of the document supply tray 96. The document feed roller 98 is driven for rotation by means of a roller drive motor 100 ($M_F$) also positioned within the housing 90 as schematically indicated at 100. A document sheet (not shown) to be copied may be placed on the document supply tray 96 through the inlet slot 92 so that the document sheet can be passed into the document transport unit 88 through the outlet slot 94 in the housing 90.

This document transport unit 88 comprises a lid structure 102 and is arranged to be rockable in its entirety away from and toward the document support table 18 about an axis extending lengthwise of the transport unit 88. The lid structure 102 comprises a conveyor mechanism including driven and idler rollers 104 and 106 spaced apart in parallel from each other and positioned in the vicinity of the front and rear ends, respectively, of the document transport unit 88. An endless transport belt 108 is passed between these rollers 104 and 106 and has a lower travelling path portion which extends in parallel with the document support table 18 and which is to travel in the direction of advancement d of document sheet. The document transport unit 88 as a whole is thus rockable between a "closed" angular position having the lower travelling path portion of the belt 108 held in slidable contact with the document support table 18 as shown and an "open" angular position spaced apart from the document support table 18. Between the driven and idler rollers 104 and 106 are arranged guide and pressing rollers 110 which are held in rollable contact with the inner surface of the lower travelling path portion of the belt 108 to press the lower travelling path portion of the belt 108 slidably against the upper face of the document support table 18 when the document transport unit 88 is maintained in the closed position. The driven roller 104 is driven for rotation about its center axis by means of a belt drive motor 112 ($M_B$) which is schematically indicated at 112. A document sheet supplied from the document supply unit 86 to the document transport unit 88 is moved by the transport belt 108 to a correct "exposure position" on the document support table 18 and is ready to be scanned by the optical scanning system 20 of the duplicator module 10. After the document sheet set on the document support table 18 is thus scanned by the optical scanning system 48, the document sheet is either withdrawn to a document recovery tray 114 forming part of the lid structure 102.

Paper Supply Module (Second Subsidiary Module)

The paper supply module 14 of the image duplicating apparatus embodying the present invention is provided for supplying a copying sheet during an ordinary mode of copying operation or recirculating a copying sheet during a duplex mode or composite mode of copying operation. By the duplex mode of copying operation, printed images are produced on the reverse face of the copy sheet which has printed images already produced on its front face. When the composite mode of copying operation is selected, original images within specified areas of a single document sheet or original images on different document sheets are reproduced on the same side of a single copying sheet.

The paper supply module 14 comprises a housing 116 having supported thereon the duplicator module 10. Within the housing 116 is provided upper and lower paper supply units 118 and 120 and a paper recirculation unit 124. These upper and lower paper supply units 118 and 120 have stored therein stocks of copying sheets of respectively different sizes. Each of the paper supply units 118 and 120 is detachably and thus exchangeably assembled into the paper supply module 12 and is movable within the housing 116 of the module 12 along a pair of guide rails **126*a* and 126*b* supporting the paper supply unit 118 and a pair of guide rails 128*a* and 128*b* supporting the paper supply unit 120. These guide rails 126*a*/126*b* and 128*a*/128*b* extend rearwardly from the front end of the housing 116 so that each of the paper supply units 118 and 120 is movable into and out of a position operatively coupled to the paper supply module 12**.

In conjunction with the upper paper supply unit 118 is provided a paper feed roller 130 which, when driven for rotation, picks copying sheets one after another from the stock of paper in the paper supply unit 118. The copying sheet thus picked up from the paper recirculation unit 118 by means of the roller 130 is guided to advance upwardly by way of guide rollers which are shown including a pair of rollers 132 located adjacent the feed roller 130, a set of rollers 134 posterior to the guide rollers 132, and a set of rollers 136 located posterior to the guide rollers 134. The set of rollers 136 is located below the passage member 62 forming part of the paper feed mechanism 24 of the duplicator module 10. The passage member 62 is downwardly open into the housing 116 of the paper supply module 14 through an opening provided at the bottom of the housing structure 16 of the duplicator module 10. The copying sheet conveyed through the roller pair 132 and roller sets 134 and 136 is thus passed over to the passage member 62 and is thus directed toward the timing roller pair 64.

Associated with the lower paper supply unit 120 is a paper feed roller 130 which, when driven for rotation, picks copying sheets one after another from the stock of paper in the paper supply unit 120. The copying sheet thus picked up from the paper recirculation unit 120 by means of the roller 138 is guided to advance upwardly by way of guide rollers which are shown including a pair of rollers 140 located adjacent the feed roller 138, a set of rollers 142 posterior to the guide rollers 140, and a pair of rollers 144 located posterior to the guide rollers 142. The pair of rollers 144 is located below and anterior to the set of rollers 134 so that the copying sheet conveyed through the roller pair 140, roller set 142 and roller pair 144 is also passed over to the passage member 62 and is thus directed toward the timing roller pair 64.

Each of the guide roller pairs and sets thus provided in the paper supply module 14 has associated therewith suitable actuator means such as a solenoid-operated clutch (not shown) and is driven by one of motors 146 and 148 ($M_1$, $M_2$) which are provided in association with the upper and lower paper supply units 118 and 120, respectively.

To perform a duplex or composite mode of copying operation, a copy sheet which has passed through the image fixing system 26 and which has images already printed and fixed on one face thereof is directed downwardly from the shifter assembly 72 and is passed through the guide rollers 82 and passageway 84 toward the paper recirculation unit 124 provided in the paper supply module 14.

The paper recirculation unit 124 is also detachably and assembled into the paper supply module 12 and is movable into and out of a position operatively coupled to the paper supply module 12 along a pair of guide rails 150*a* and 150*b* extending rearwardly from the front end of the housing 116. The paper recirculation unit 124 comprises a housing 152 having an inlet end below the passageway 84 extending downwardly into the paper supply module 14 from the duplicator module 10 and an outlet end located in the vicinity of the uppermost set of guide rollers 136 in the paper supply module 14 as shown. Within the housing 152 is positioned a recirculation tray member 154 on which a copying sheet admitted into the paper recirculation unit 124 is to be received until the copying sheet is thereafter supplied from the unit 124.

Adjacent the inlet end of the housing 152 is provided a pair of guide rollers 156 and an associated shift member 158 located immediately posterior to the roller pair 156 in the direction of travel of copying sheet from the passageway 84. The shifter member 158 is rockable about a pivot element 160 between a first angular position for allowing a copying sheet to travel from the roller pair 156 toward the outlet end of the paper recirculation unit 124 and a second angular position for allowing a copying sheet to travel from the roller pair 156 directly onto the recirculation tray member 154.

The copying sheet passed from the roller pair 156 toward the outlet end of the paper recirculation unit 124 with the shifter member 158 travels through pairs of guide rollers 162 and 164 to a curved guide member 166 which is curved backwardly toward the recirculation tray member 154 as shown. In the vicinity of the leading end of the guide member 166 is positioned a pair of guide rollers 168 so that the copying sheet which has travelled to the guide member 166 is passed to and received on the recirculation tray member 154. Adjacent the forward end of the tray member 154 is provided a shifter member 170 having a paper feed roller 172 carried thereon. The shifter member 170 is rockable about a pivot element 174 between a first angular position (indicated by full lines) operative to pick up a copying sheet from the recirculation tray member 154 and a second angular position (indicated by dot-and-dash lines) allowing a copying sheet to pass from the guide roller pair 168 to the tray member 154. The copying sheet picked up from the tray member 154 by means of the feed roller 172 on the shifter member 170 moved to the second angular position thereof is passed to the uppermost set of guide rollers 136 of the paper supply module 14 through a pair of guide rollers 174 located in the vicinity of the outlet end of the paper recirculation unit 124.

When the rockable two-way guide member 78 of the shifter assembly 72 is turned to the angular position to pass a copy sheet downwardly from the first pair of guide rollers 74, the copy sheet passed through the pair of guide rollers 82 enters the paper supply module 14 by way of the passageway 84 and is admitted into the paper recirculation unit 124 through the inlet end of the paper recirculation unit 124 by means of the guide rollers 156. If the shifter member 170 associated with the guide rollers 156 has been turned about the pivot element 174 to the first angular position thereof, the copying sheet is allowed to travel from the roller pair 156 toward the outlet end of the paper recirculation unit 124 and is thus received thereon. In this instance, the copying sheet has images printed on one side thereof and is received on the recirculation tray member 154 in such a manner as to have its printed face directed downwardly. If, on the other hand, the shifter member 170 is held in the second angular position thereof, then the copying sheet passed through the guide roller pair 156 is directed through the guide roller pairs 162 and 164 to the curved guide member 166 and is passed to and received on the recirculation tray member 154. Under these conditions, the shifter member 170 located adjacent the forward end of the recirculation tray member 154 is held in the angular position allowing the copying sheet to pass from the guide roller pair 168 to the tray member 154. In this instance, the copying sheet which has been conveyed to the curved guide member 166 also has images printed on one side thereof and is turned out when being transferred from the guide member 166 to the recirculation tray member 154. The copying sheet which is received on the tray member 154 through the guide member 166 has its printed face directed upwardly.

When there is a stock of copying sheets thus received successively on the recirculation tray member 154, the sheets are picked up and supplied one after another from the tray member 154 in a "last-in first-out" fashion. The copying sheet thus supplied from the recirculation tray member 54 is conveyed through the roller pair 174 and roller set 136 and is passed over to the passage member 62 in the duplicator module 10. From the passage member 62, the copying sheet is fed through the timing roller pair 64 to the image transfer drum 44 so that images are further printed on the copying sheet. On one face of the copying sheet recirculated to the drum 44 have been printed either the images reproduced from one specified area of a document sheet or the images on another document. While the copying sheet is being passed through the guide rollers 174 and 136 and passage member 62, the sheet is turned out.

Accordingly, the copying sheet recirculated to the drum 44 has its printed face directed downwardly if the particular sheet has been placed on the recirculation tray member 154 with the printed face directed upwardly. Alternatively, the copying sheet recirculated to the drum 44 has its printed face directed upwardly if the particular sheet has been placed on the tray member 154 with the printed face directed downwardly. Thus, if the copying sheet is passed to the recirculation tray member 154 directly from the guide rollers 156, the images reproduced from another specified area of the document sheet will be printed on the already printed face of the copying sheet recirculated to the drum 44. This mode of operation is herein referred to as composite mode of copying operation. If the copying sheet is passed to the recirculation tray member 154 through the curved guide member 166, the images reproduced from another specified area of the same document sheet or from another document sheet will be printed on the opposite plain or non-printed face of the copying sheet recirculated to the drum 44. This mode of operation is herein referred to as duplex mode of copying operation.

Figure 2A:
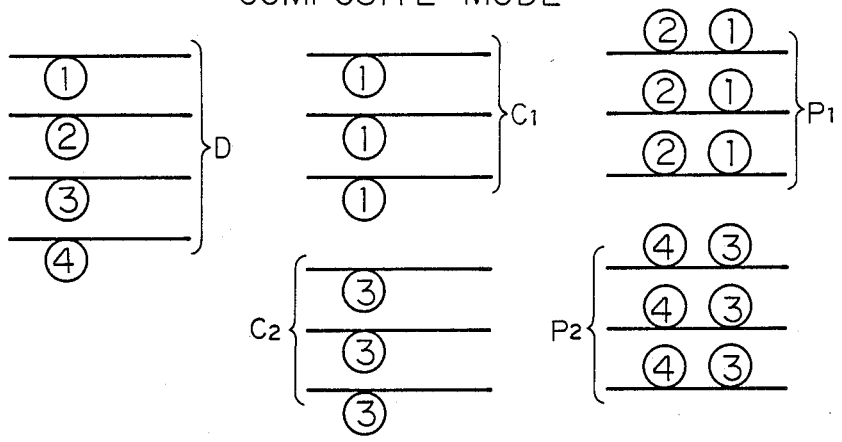
FIGS. 2A and 2B are diagrams schematically showing the principles of operation on which composite and duplex modes of copying operation are to be performed in the image duplicating apparatus embodying the present invention.
Figure 2B:
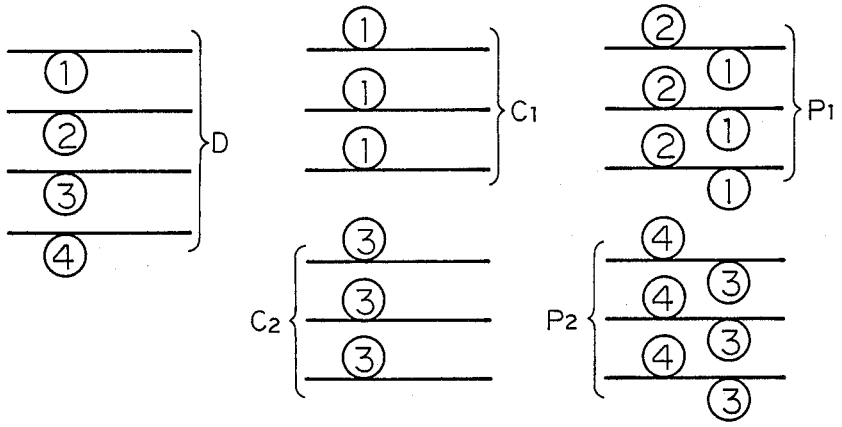

FIGS. 2A and 2B schematically show the principles of operation on which such composite and duplex modes of copying operation are to be performed, wherein the numerals indicated within circles represent the images on four original document sheets D, the images first reproduced on two sets of three copying sheets $C_1$ and $C_2$, and the images finally reproduced on the two sets of print outputs $P_1$ and $P_2$.

Sensors and Detectors

The image duplicating apparatus embodying the present invention further comprises various sensors and detectors arranged within the main and subsidiary modules. Such sensors and detectors include those provided in association with the optical scanning system 20 of the duplicator module 10. The sensors associated with the optical scanning system 20 include a home position sensor 176 located in association with, for example, the document scanner 28/30. The home position sensor 176 is responsive to movement of the document scanner 28/30 to and from a predetermined home position with respect to the document support table 18 and is adapted to produce an output signal $S_{HP}$ in the presence of the document scanner 28/30 in the home position.

On the other hand, the automatic document feed module 12 of the apparatus has provided therein a document sensor 178 located in conjunction with the document supply tray 96 of the document supply unit 86. The document sensor 178 is responsive to the presence or absence of at least one document sheet on the document supply tray 96 and is operative to produce an output signal $S_{DS}$ in the presence of a document sheet on the tray 96. On the other hand, the document transport unit 88 has provided therein a document feed sensor 180. The document feed sensor 180 is located adjacent the inlet of the document transport unit 88 and is responsive to passage of a document sheet into the document transport unit 88 to produce an output signal $S_{DF}$ in response to a document sheet advancing into the document transport unit 88. Though not shown, there are further provided a sensor to detect the size of the document sheet supplied into the transport unit 88, and a sensor to detect the angular position thereof over the document support table 18.

In the paper supply module 14 are provided sensors and detectors including those used to determine the types of the paper supply units 118 and 120 and accordingly the sizes of the copying sheets stored in the paper supply units. Such sensors include paper size sensors 182 and 184 located in association with the upper and lower paper paper supply units supply paper supply 118 and 120, respectively. The paper size sensor 182 associated with the upper paper supply paper supply unit 118 is responsive to the size of the copying sheets stored in the paper supply unit 118 and is adapted to produce an output signal $S_{PZ1}$ indicative of the detected size of the copying sheets in the paper supply unit 118. The paper size sensor 184 associated with the lower paper supply unit 120 is responsive to the size of the copying sheets stored in the paper supply unit 120 and is adapted to produce an output signal $S_{PZ2}$ indicative of the detected size of the copying sheets in the paper supply unit 120.

In the paper supply module 14 are further provided a paper transfer sensor 186 to detect a transfer of a copying sheet from the duplicator module 10 to paper supply module 14, a tray empty sensor 188 to detect an absence of copying sheet on the recirculation tray member 154, and a recirculation paper supply sensor 190 to detect a transfer of a copying sheet from the paper recirculation unit 124 to the duplicator module 10. The paper transfer sensor 186 is located in the vicinity of the inlet end of the paper recirculation unit 124 and is operative to produce a signal $S_{CD}$ in response to passage of of a copying sheet into the paper recirculation unit 124. The tray empty sensor 188 is located in conjunction with the recirculation tray member 154 and is operative to produce a signal $S_{TE}$ upon detection of the absence of copying sheet on the tray member 154. The recirculation paper supply sensor 190 is located in the vicinity of the outlet end of the paper recirculation unit 124 and is operative to produce a signal $S_{RS}$ in response to passage of a copying sheet out of the paper recirculation unit 124. The signal $S_{RS}$ thus produced by the recirculation paper supply sensor 190 is transmitted to a paper supply counter incorporated in a microprocessor forming part of the control circuit of the apparatus embodying the present invention. The paper supply counter counts the number of the copying sheets which have been recirculated from the paper recirculation unit 124 and enables the microprocessor to produce a flag $N_{TP}$ indicative of the number of the copying sheets thus counted. The flag $N_{TP}$ produced by the microprocessor indicates the number of the copying sheets supplied from the paper recirculation unit 124 for a single document sheet and is accordingly also indicative of the number of the print outputs produced during copying of the particular document sheet.

Figure 3:
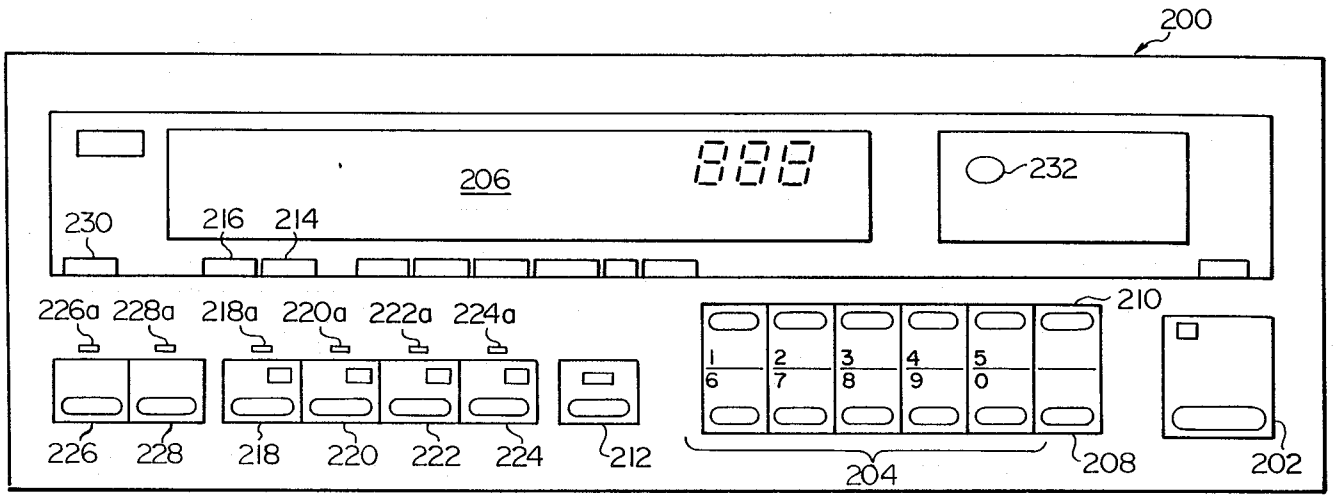
FIG. 3 is a plan view schematically showing the general configuration of the control panel forming part of the image duplicating apparatus embodying the present invention.

The various functions achievable by the image duplicating apparatus embodying the present invention will be understood from the following description regarding the general configuration of a control panel forming part of the image duplicating apparatus. FIG. 3 shows the general configuration of the control panel which is in its entirety represented by reference numeral 200.

Referring to FIG. 3, the control panel 200 comprises a print start switch 202 to enable the apparatus to start duplicating operation and a set of numerical switches 204 allocated to numerals 1, 2, . . . and 0, respectively, and used to enter a selected quantity of copying sheets to be printed. A print start signal $S_{PS}$ is produced when the print start switch 202 is depressed. The quantity of copying sheets entered from the numerical switches 204 is displayed on a seven-segment type numerical data display section 206 of the control panel 200 and can be cleared from a clear/stop switch 208 which may be used also for cancelling the instruction once entered from the print start switch 202. During printing of a preset quantity of copying sheets for a given document sheet, another document sheet may be duplicated in an interrupt mode entered at an interrupt request switch 210.

The size of copy sheets to be used can be selected at a manual paper-size select switch 112 from among a predetermined number of sizes available. Different sizes of copy sheets are numerically displayed successively on the display section 206. Further provided are print density increment and decrement switches 214 and 216 to permit manual selection of a desired print density for the copy sheets to be printed. The print density is stepwise incremented with the switch 214 depressed or decremented with the switch 216 depressed and is also displayed on the display section 206. On the control panel 200 are further provided a set of magnification ratio select switches 218, 220, 222 and 224 having associated indicator lamps 218a, 220a, 222a and 224a, respectively. When any of the switches 218 to 224 is depressed, the associated one of the indicators lamps 218a, 220a, 222a and 224a is turned on illuminate to indicate the selected ratio of magnification.

There are further provided a duplex copy mode select switch 226 and a composite copy mode select switch 228 with respectively associated indicator lamps 226a and 228a as shown. As noted previously, the duplex copy mode select switch 226 is used for producing printed images on the opposite faces of the copy sheet. The composite copy mode select switch 228 is used for carrying out a composite mode of copying operation in which original images within specified areas of a single document sheet or original images on different document sheets are to be reproduced on a single face of a single copying sheet. When the duplex copy mode select switch 226 is depressed and the associated indicator lamp 226a is turned on to illuminate, a signal $S_D$ is produced and supplied to the microprocessor forming part of the control circuit of the apparatus to indicate that a duplex mode of copying operation is currently requested. Likewise, the composite copy mode select switch 228 when depressed produces a signal $S_C$ and at the same time the associated indicator lamp 228a is turned on to illuminate, thereby indicating that a composite mode of copying operation is currently requested. Indicated at 230 is a switch used for producing a signal $S_{DV}$ effective to feed a copying sheet through the duplicator module 10 or through the duplicator and paper supply modules 10 and 14 without duplicating and printing images on the sheet. If there is a copying sheet on the recirculation tray member 154 when the switch 230 is depressed, the paper recirculation unit 124 is actuated to feed the sheet out of the paper recirculation unit 124 in response to the signal $S_{DC}$.

The control panel 200 of the apparatus embodying the present invention further comprises a warning lamp 232 which is to be turned on to illuminate when it is found that the number of printed outputs produced by the end of the operation for the copying of the same document sheet is not equal to the desired total number N of prints entered from the numerical switches 204.

Figure 4:
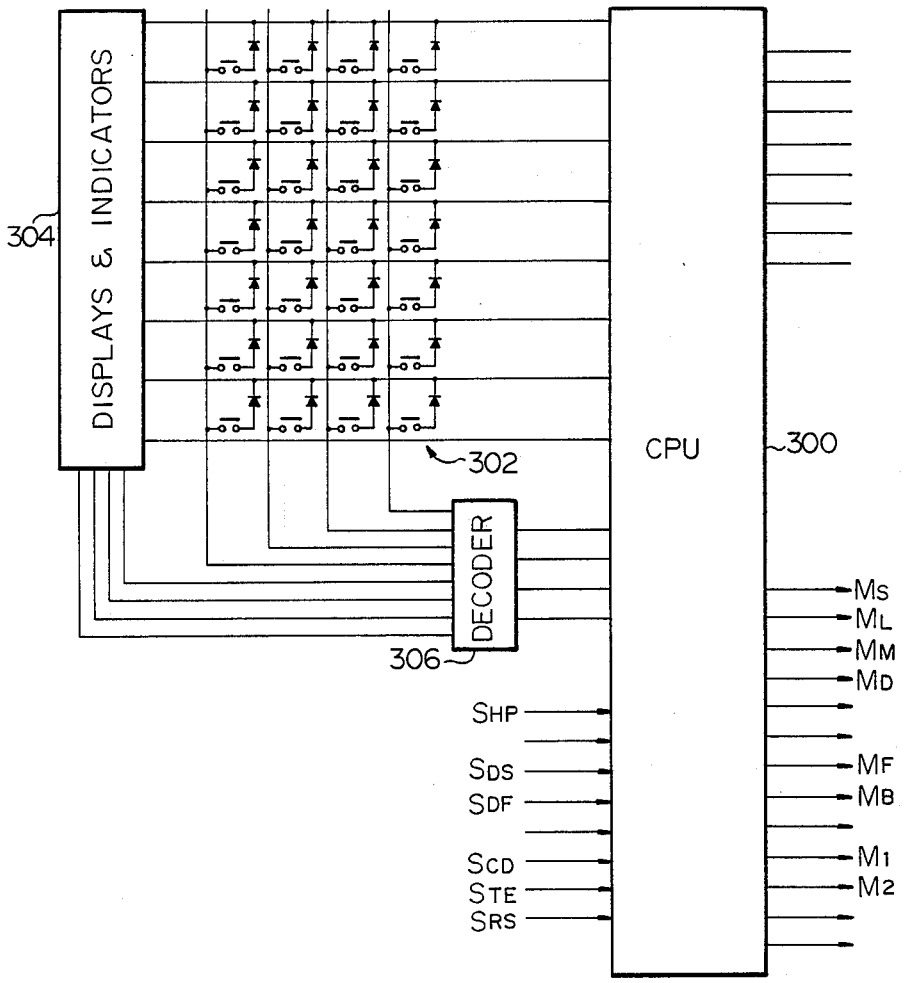
FIG. 4 is a block diagram schematically showing the general arrangement of a control circuit which may be incorporated in the image duplicating apparatus embodying the present invention.

FIG. 4 shows the general arrangement of a control circuit which may be used to achieve the various modes and conditions of copying operation in the apparatus embodying the present invention. The control circuit comprises a microprocessor 300 (hereinafter referred to as CPU) which has input terminals responsive to the signal which may be produced by various switch elements including those provided on the control panel 200 and the signals to be produced by the various sensors included in the duplicator module 10, automatic document feed module 12 and paper supply module 14. As described previously, the signals to be produced by such sensors include the signal $S_{HP}$ to be produced by the home position sensor 176, the signal $S_{DS}$ to be produced by the document sensor 178, the signal $S_{DF}$ to be produced by the document size sensor 186, the signal $S_{PZ1}$ to be produced by the paper size sensor 182, the signal $S_{PZ2}$ to be produced by the paper size sensor 184, the signal $S_{CD}$ to be produced by the paper transfer sensor 186, the signal $S_{TE}$ to be produced by the tray empty sensor 188, the signal $S_{RS}$ to be produced by the recirculation paper supply sensor 190, and the print start signal $S_{PS}$ to be produced when the print start switch 202 is depressed. Data represented by these signals and data entered from the switch elements on the control panel 200 are stored through the CPU 300 into a random-access memory (not shown) having a backup power supply source.

The CPU 300 further has output terminals connected to the drivers and actuators for the scanner drive motor 40 ($M_S$), the lens drive motor 42 ($M_L$), the main drive motor $M_M$, the developer drive motor $M_D$, the clutch for the timing rollers 64, the chargers 48, 54, and 56, and the eraser lamp 60 in the duplicator module 20. The drivers and actuators connected to the output terminals of the CPU 300 further include those for the roller drive motor 100 ($M_F$) and belt drive motor ($M_B$) provided in the automatic document feed module 12, and the motors 146 and 148 ($M_1$, $M_2$) and the various rollers provided in the paper supply module 14. The CPU 300 further has output terminals connected through a switch circuit 302 to the various display and indicator elements and the display sections 206 and 232 of the control panel (herein collectively represented by block 304). These display and indicator elements and sections 304 and the switch circuit 302 are also connected to the CPU 300 through a decoder circuit 306 as shown. It may be noted that the CPU 300 herein shown may be understood to represent a circuit consisting of two or more microprocessors which are respectively predominant over the operation of the duplicator module, automatic document feed module 12 and paper supply module 14.

Figure 5:
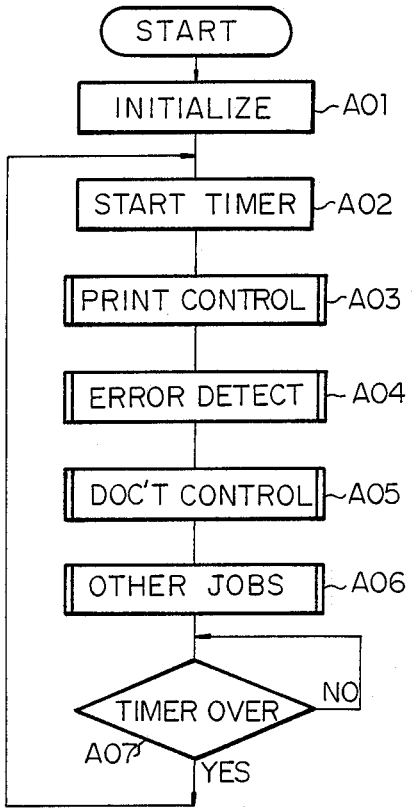
FIG. 5 a flowchart showing a preferred example of the main routine program to be executed by a master microprocessor included in the control circuit illustrated in FIG. 3.

FIG. 5 shows a preferred example of the main routine program program to be executed by the master CPU 300. Referring to FIG. 5, such a main routine program program is started with the apparatus switched in and at a step A01 initializes the master CPU 300. All the data representative of the copying conditions and modes of operation that may have been memorized in the memory and registers of the CPU 300 are thus initialized in accordance with prescribed "default" rules. An internal timer of the system is then started at a step A02 to count the time interval predetermined for a single complete iteration through the routine program. The master CPU 300 may then execute a print control subroutine program A03. The details of the print control subroutine program A03 will be hereinafter described with reference to FIG. 6.

The main routine program to be executed by the master CPU 300 further includes an error detect subroutine program A04 to detect if the number of printed outputs produced by the end of the copying operation for a given document sheet equals the desired total number of prints entered from the control panel 200. The details of this error detect subroutine program A04 will be hereinafter described with reference to FIG. 7. The master CPU1 408 may further execute a document control subroutine program A05. The details of this document control subroutine program A04 will be hereinafter described with reference to FIG. 8.

The master CPU1 408 may further proceed to other subroutine programs to perform various other jobs required for performing various modes of operation or operation under various other conditions. Upon lapse of the time counted by the internal timer of the CPU 300 as started at step A02, the system reverts to the step A02 and recycles the subroutine programs A03 to A09.

Description will be hereinafter made with reference to FIG. 6 to FIG. 10 in regard to the various subroutine programs included in the main routine program hereinbefore described.

Figure 6:
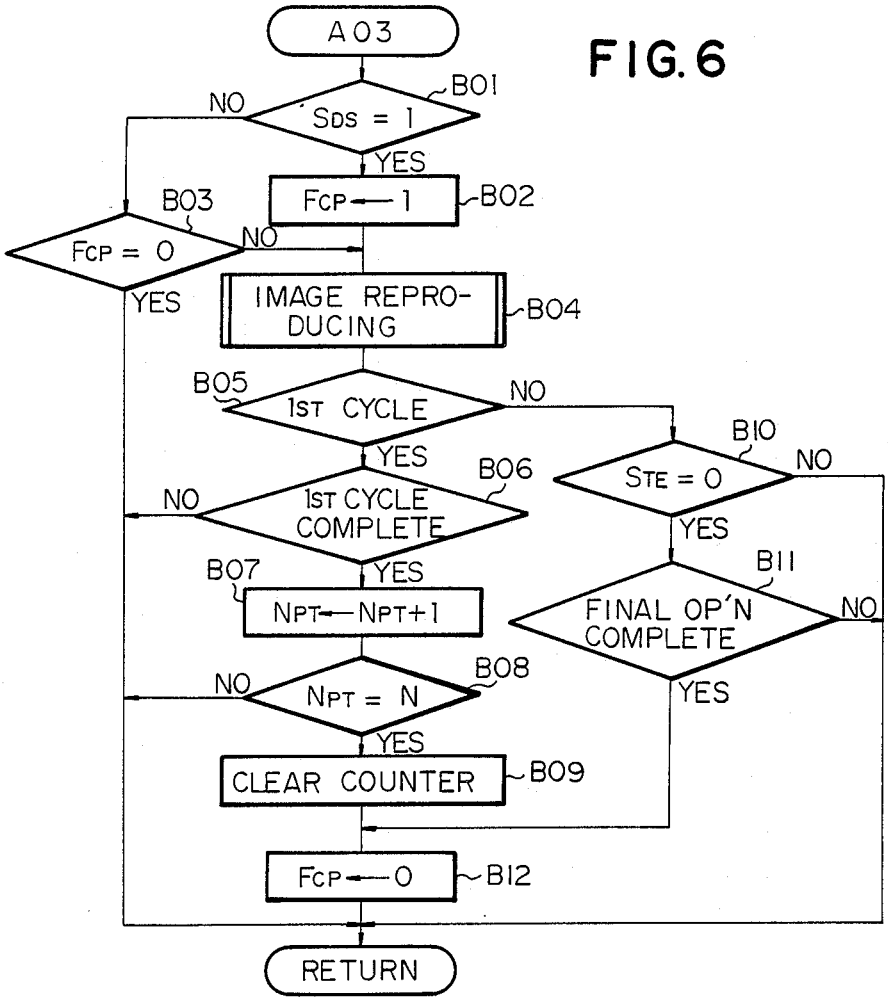
FIG. 6 is a flowchart showing the details of a print control subroutine program included in the main routine program illustrated in FIG. 5.

FIG. 6 shows the details of the print control subroutine program A03 included in the main routine program described with reference to FIG. 5.

Referring to FIG. 6, the print control subroutine program A03 starts with a decision step B01 at which it is confirmed whether or not there is a signal $S_{DS}$ produced by the document sensor 178 responsive to a document sheet placed on the document supply tray 96 of the automatic document feed module 12. If it is found that there is such a signal $S_{DS}$, a flag $F_{CP}$ of a logic "1" state indicating that copying operation is in progress is set at step B02. When it is found at step B01 that there is no signal $S_{DS}$ produced by the document sensor 178, it is questioned at step B03 whether or not the flag $F_{CP}$ is of a logic "0" state. If the answer for this step step B03 is given in the negative, the subroutine program returns to step B01.

Subsequently to step B02 or when the answer for the step B03 is given in the affirmative, a subroutine program B04 is executed to enable the duplicator module 10 to reproduce images from the document sheet on the table 18 to a copying sheet supplied from the paper supply module 14. The particulars of such a subroutine program B04 being well known in the art and being rather immaterial to the understanding of the subject matter of the present invention, the details of such a subroutine program are not herein shown and described. Upon termination of the subroutine program B04, it is checked at a step B05 whether or not the current cycle of copying operation is the earlier or "first" half cycle of the two cycles of composite or duplex mode of operation which is currently in progress. If it is found at this step B05 that this is the case, it is tested at step B06 whether or not the copying operation for the current "first" half cycle is complete. If it is found at this step B06 that the current cycle of copying operation is complete, the flag $N_{TP}$ indicative of the number of the printed outputs which have been produced for the document sheet currently placed on the document support table 18 is incremented by one at step B07. Thereupon, it is confirmed at step B08 whether or not the number of printed outputs indicated by the flag $N_{TP}$ thus updated equals the desired total number N of prints entered from the control panel 200. If the answer for this step B08 is given in the affirmative, the paper supply counter incorporated in the CPU 300 as previously noted is cleared at step B09.

If it is found at the step B05 that the current cycle of copying operation is the later or "second" half cycle of the two cycles of composite or duplex mode of operation which is currently in progress, it is tested at step B10 whether or not the copying sheets which have been stored in the paper recirculation unit 124 of the paper supply module 14 are used up. This decision is made through detection of the signal $S_{TE}$ supplied from the tray empty sensor 188 provided in the paper recirculation unit 124. When it is found that there is present such a signal supplied from the sensor 188, it is tested at step B11 whether or not the final cycle of copying operation is complete. When the answer for this step B11 is given in the affirmative or subsequently to the step B09 at which the paper supply counter has been cleared, the flag $F_{CP}$ of the logic "1" state indicating that copying operation is in progress is shifted to logic "0" state at step B12.

Figure 7:
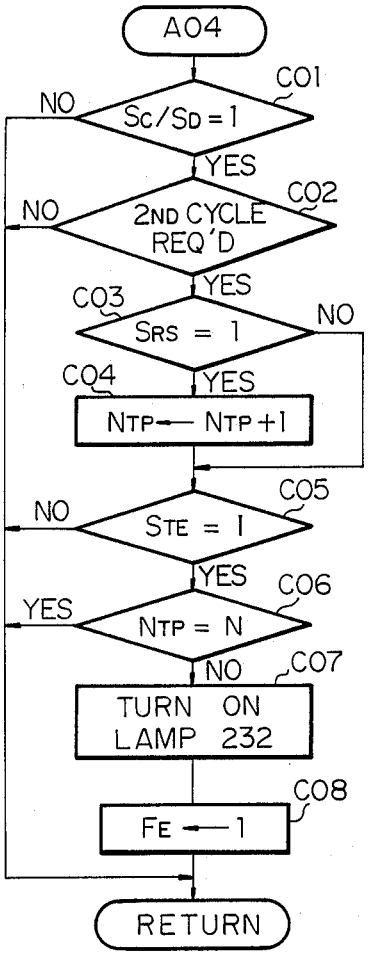
FIG. 7 is a flowchart showing the details of an error detect subroutine program included in the main routine program illustrated in FIG. 5.

FIG. 7 shows the details of the error detect subroutine program A04 included in the main routine program described with reference to FIG. 5.

Referring to FIG. 7, the error detect subroutine program A04 starts with a decision step C01 at which it is confirmed whether or not there is a signal $S_D$ produced with the duplex copy mode select switch 226 depressed or a signal $S_{DS}$ produced with the composite copy mode select switch 228 depressed. If it is found that there is such a signal $S_D$ or $S_C$, it is checked at step C02 whether or not the later or "second" one of the two cycles of composite or duplex mode of operation which is currently in progress is to be performed. This decision may be made through detection of the signal $S_{TE}$ of logic "0" state from the tray empty sensor 188 indicating that there is a copying sheet stored in the paper recirculation unit 124.

If it is found at this step C02 that there is in the paper recirculation unit 124 a copying sheet to be further printed, it is tested at step C03 whether or not there is produced a signal $S_{RS}$ from the sensor 190 indicating that a copying sheet is recirculated from the paper recirculation unit 124 to the duplicator module 10. When it is found that there is such a signal produced from the sensor 190, the flag $N_{TP}$ indicative of the number of the printed outputs which have been produced for the document sheet on the document support table 18 is incremented by one at step C04. Thereupon, it is confirmed at step C05 whether or not the copying sheets which have been stored in the paper recirculation unit 124 of the paper supply module 14 are used up. This decision is made through detection of the signal $S_{TE}$ supplied from the tray empty sensor 188 provided in the paper recirculation unit 124. When it is found that there is present such a signal supplied from the sensor 188, it is further tested at step C06 whether or not the number of printed outputs indicated by the flag $N_{TP}$ updated at the step C04 equals the desired total number N of prints entered from the control panel 200. If the answer for this step C06 is given in the affirmative, the subroutine program reverts to step C01.

If it is found at the step C06 that the number of printed outputs indicated by the flag $N_{TP}$ is not equal to the desired total number N of prints, then the warning lamp 232 is turned on to illuminate as at step C07 and then at step C08 an error flag $F_E$ of logic "1" state is set to prohibit the automatic document feed module 12 from feeding a subsequent document sheet if any.

In this instance, a signal similar in effect to the signal $S_{DV}$ to be produced with the switch 230 depressed may be produced concurrently as the error flag $F_E$ of logic "1" state is set. In response to such a signal similar to the signal $S_{DV}$, the paper recirculation unit 124 is actuated so that the copying sheet or sheets remaining on the recirculation tray member 154 are discharged out of the paper recirculation unit 124 with no image reproducing processed performed in the duplicator module.

Figure 8A:
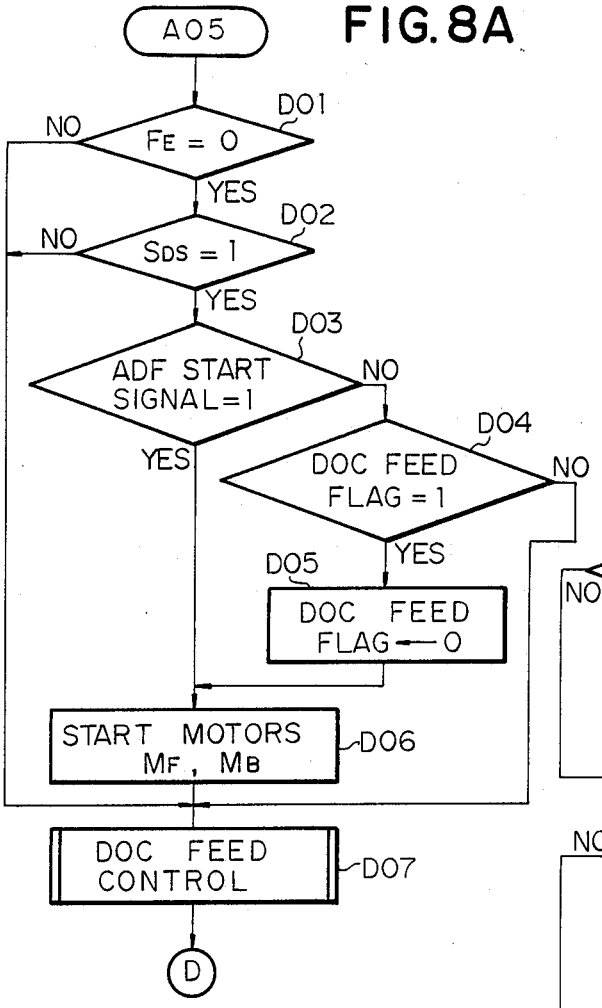
FIGS. 8A and 8B are flowcharts of a document control subroutine program included in the main routine program illustrated in FIG. 5.
Figure 8B:
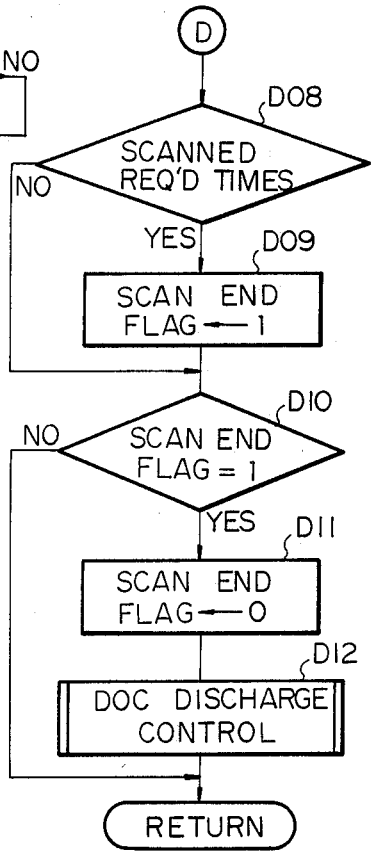

FIGS. 8A and 8B show the document control subroutine program A05 included in the main routine program described with reference to FIG. 5.

Referring first to FIG. 8A, the document control subroutine program A05 starts with a step D01 at which is questioned whether or not the error flag $F_E$ as previously mentioned is of a logic "0" state indicating that the number of printed outputs produced by the end of the copying operation terminated for a document sheet is equal to the desired total number N of prints entered from the control panel 200. If it is found at the step D01 that the error flag $F_E$ is of the logic "0" state, it is tested at step D02 whether or not there is a document sheet placed on the document support table 18 of the duplicator module 10. If it is found at this step D02 that there is a document sheet on the document support table 18, the step D02 is followed by a step D03 which is responsive to an automatic document feed start signal supplied from the CPU 300. At the step D03 is thus queried whether or not there is present the automatic document feed start signal of, for example, a logic "1" state. If it is found at the step D03 that there is absent the automatic document feed start signal of logic "1" state, then the step D03 is followed by a step D05 to query whether or not a document feed flag of, for example, a logic "1" state is currently present. If the answer for this step D05 is given in the affirmative, then the document feed flag is shifted to logic "0" state at step D05. Subsequently to the step D05 or if it is found at the step D03 that the automatic document feed start signal of logic "1" state is present, the subroutine program also proceeds to a step D06 at which an instruction signal is issued from the CPU 304 so that the roller drive motor 100 ($M_F$) in the document supply unit 86 and the belt drive motor 112 ($M_B$) in the document transport unit 88 of the automatic document feed module 12 are actuated to start. In this instance, the belt drive motor 112 is actuated so that the endless transport belt 108 is to be driven to have its lower travelling path portion moved forwardly in the direction of arrow d shown in FIG. 1.

Subsequently to the step D06 or if it is found at the step D02 that there is no document sheet placed on the document support table 18, the subroutine program proceeds through a connector P to a document feed control subroutine program D07. The document feed control subroutine program D07 is executed also when it is found at step D01 that the error flag $F_E$ is of logic "1" state indicating that the number of printed outputs produced by the end of the copying operation terminated for a document sheet is not equal to the desired total number N of prints. Details of this document feed control subroutine program D07 will be hereinafter described with reference to FIG. 9.

Upon completion of the document feed control subroutine program D07, the subroutine program proceeds to a step D08 shown in FIG. 8B to question whether or not the scanning operation has been repeated the required number of times. If the answer for this step D08 is given in the affirmative, then a scan complete flag of, for example, a logic "1" state is raised at step D09. Subsequently to this step D09 or if it is found at the preceding step D08 that the scanning operation has not been repeated the preset number of times, then it is questioned at a step D10 whether or not the scan complete flag of logic "1" state is present. If the answer for this step D10 is given in the affirmative, the scan complete flag of the logic "1" state is shifted to logic "0" state at step 11 and, thereupon, the subroutine program proceeds to a document discharge subroutine program D12. Details of this document discharge subroutine program D12 will be hereinafter described with reference to FIG. 10. Subsequently to the subroutine program D11, the subroutine program A05 reverts to the initial step D01 shown in FIG. 8A.

Figure 9:
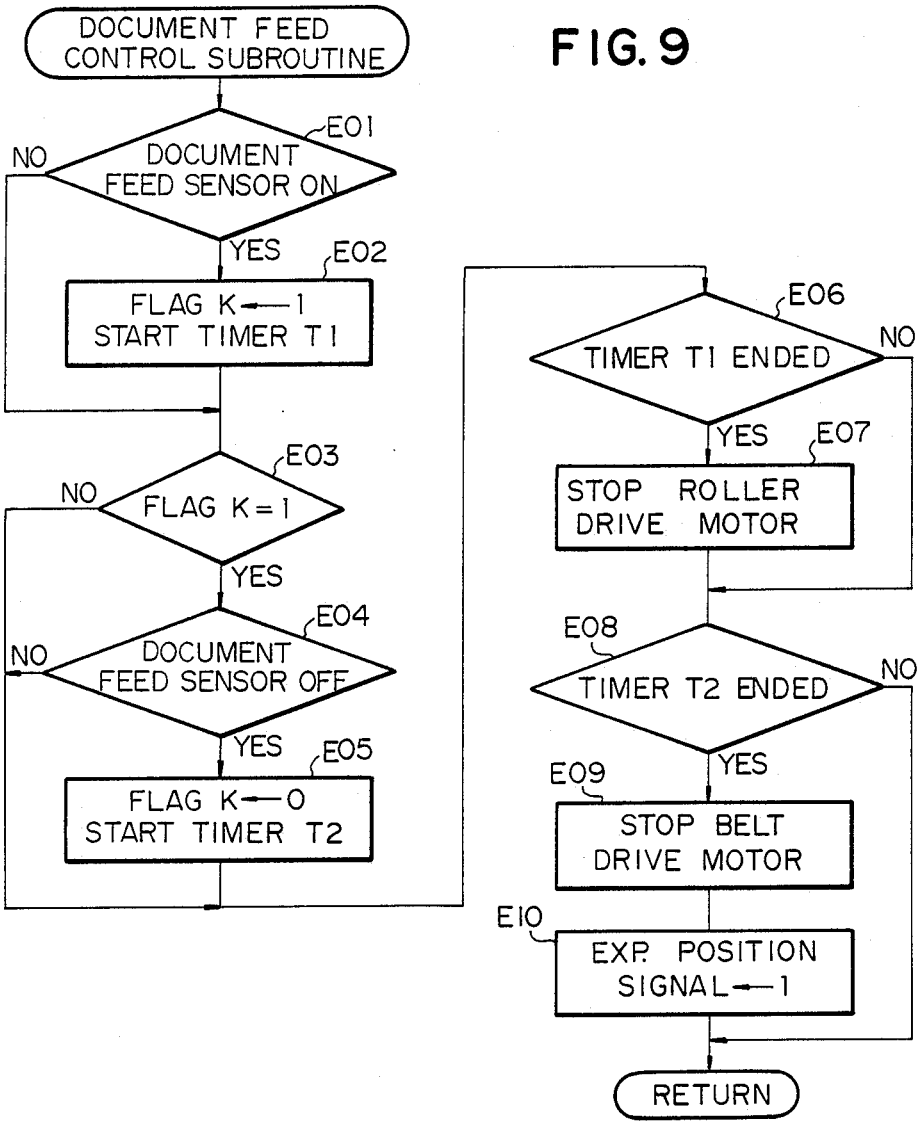
FIG. 9 is a flowchart of a document feed control subroutine program included in the document control subroutine program illustrated in FIGS. 8A and 8B.

FIG. 9 is a flowchart of a document feed control subroutine program D07 included in the document control subroutine program A05 described with reference to FIGS. 8A and 8B.

Referring to FIG. 9, the document feed control subroutine D07 is executed to transport a document sheet detected by the document feed sensor 180 to a correct exposure position on the document support table 18 of duplicator module 10 by means of the transport belt 108 of the document transport unit 88. Such a subroutine program D07 starts with a step E01 at which is queried whether or not there is an active signal produced by the document feed sensor 180. If it is found at the step E01 that such a signal is present, a flag "K" of, for example, a logic "1" state for memorizing the condition of the document feed sensor 180 is set at step and at the same time a first system timer "T1" of the CPU 304 is enabled to start counting operation at step E02. For this first system timer "T1" is set a period of time for which the roller drive motor 100 in the document supply unit 86 is to be actuated to operate continuously. The roller drive motor 100 being thus actuated, the document sheet which has been placed into the document supply unit 86 is driven to travel forwardly into the document transport unit 88 until the sheet is brought into contact with the travelling transport belt 108.

Subsequently to the step E02 or if it is found at the preceding step E01 that there is no active signal output, from the document feed sensor 180, it is questioned at a step E03 whether or not the flag "K" of logic "1" state is present. If the answer for this is given in the affirmative, it is further queried at a step E04 whether or not there is an inactive signal output from the document feed sensor 180. If it is found at this step E04 that such a signal is present, the flag "K" is shifted to a logic "0" state and at the same time a second system timer "T2" of the CPU 304 is enabled to start counting operation at step E05. For this second system timer "T2" is set a time when the document sheet travelling forwardly on the document support table 18 reaches a position having its trailing end at the rearmost end of the correct exposure position on the document support table 18. Subsequently to the step E05 or it is found at the preceding step E03 that there is no flag "K" present or at the step E04 that there is no inactive signal output from the document sensor 186, the subroutine program proceeds to a step E06 to query whether or not the time preset for the first system timer "T1" has lapsed. If the answer for this step E06 is given in the affirmative, then the roller drive motor 100 in the document supply unit 86 is de-energized to come to a stop at step E07. Subsequently to this step E07 or if it is found at the preceding step E06 that the counting operation by the first system timer "T1" is still in progress, it is questioned at a step E08 whether or not the time preset for the second system timer "T2" has lapsed. If the answer for this step E08 is given in the affirmative, then the belt drive motor 146 in the document transport unit 88 is brought to a stop at step E09 and thereafter the exposure position signal is shifted to a logic "0" state at step E10. Subsequently to the step E10 or if it is found at the preceding step E08 that the second system timer "T2" is still in operation, the subroutine program recycles to the initial step E01.

Figure 10:
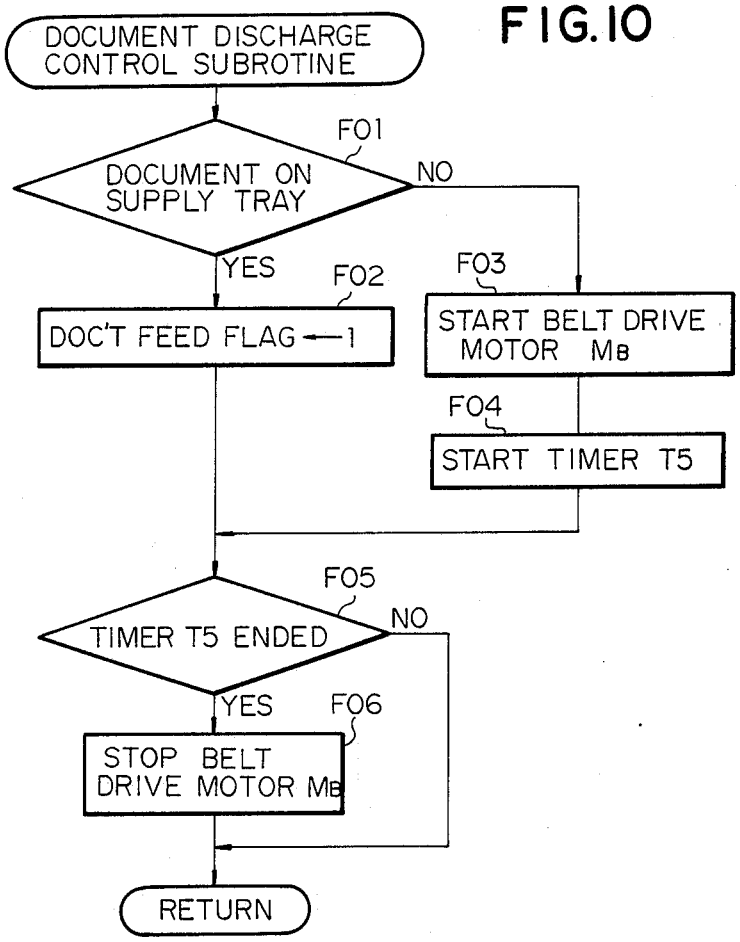
FIG. 10 is a flowchart of a document discharge control subroutine program included in the document control subroutine program illustrated in FIGS. 8A and 8B.

FIG. 10 is a flowchart of the document discharge control subroutine program D12 included in the document control subroutine program A05 described with reference to FIGS. 8A and 8B.

The document discharge control subroutine D12 is executed to determine whether or not there is a document sheet inserted into the document supply unit 86 and, if a document sheet is found inserted thereinto, memorizes the particular event and, if there is no document sheet found therein, then causes the document sheet on the document support table 18 to withdraw therefrom.

Referring to FIG. 10, such a document discharge control subroutine D12 starts with a step F01 to confirm whether or not there is a document sheet remaining in the document supply unit 86. This confirmation is made on the basis of the signal $S_{DS}$ supplied from the document sensor 178 located within the document supply unit 86. If it is found at this step F01 that there is a document sheet in the document supply unit 86, the document feed flag of a logic "1" state is raised at step F02. If the answer for the step F02 is given in the negative, then the belt drive motor 112 in the document transport unit 88 is actuated for rotation in the forward rotation as at step F03 so that the document sheet on the document support table 18 is driven by the transport belt 108 for forward movement on the table 18. A fifth system timer "T5" of the CPU 304 is then enabled to start counting operation at step F05. For this fifth system timer "T5" is set the time for which a document sheet of possibly the largest size that may be placed on the support table 18 will be allowed to move on and leave the document support table 18. Either the step F02 or the step F04 is followed by a step F05 at which is tested whether or not the fifth system timer "T5" has terminated its counting operation. If it is found at the step F05 that this is the case, the belt drive motor 112 is de-energized to come to a stop at step F06. Subsequently to the step S6 or if it is found at the preceding step F05 that the fifth system timer "T5" of the CPU 304 is still in operation, the subroutine program reverts to the initial step R01.

What is claimed is:

1. An image duplicating apparatus having a mode of copying operation which includes two consecutive cycles, comprising (a) image reproducing means for reproducing on a copying sheet a visible image duplicated from an original image on a document sheet, (b) document feed means for automatically feeding a document sheet to and from a position enabling said image reproducing means to reproduce the visible image on a copying sheet, (c) paper recirculation means for receiving from said image reproducing means the copying sheet on which said visible image has been reproduced during the earlier cycle of copying operation, said paper recirculation means being operative to recirculate the copying sheet toward said image reproducing means during the later cycle of copying operation, (d) means for detecting a difference between the number of copying sheets received by said paper recirculation means during said earlier cycle of copying operation and the number of copying sheets recirculated from said paper recirculation means during said later cycle of copying operation for producing a signal when said difference is detected upon completion of said two consecutive cycles of copying operation, and (e) control means responsive to said signal for disabling said document feed means from feeding a document sheet to said position.

2. An image duplicating apparatus as set forth in claim 1, in which said mode of copying operation has an earlier cycle of operation to reproduce a visible image on any face of a copying sheet and a later cycle of operation to reproduce a visible image also on said face of the copying sheet.

3. An image duplicating apparatus as set forth in claim 1, in which said mode of copying operation has an earlier cycle of operation to reproduce a visible image on any face of a copying sheet and a later cycle of operation to reproduce a visible image on the opposite face of the copying sheet.

4. An image duplicating apparatus having a mode of copying operation which includes two consecutive cycles, comprising (a) image reproducing means for reproducing on a copying sheet a visible image duplicated from an original image on a document sheet, (b) paper recirculation means for receiving from said image reproducing means the copying sheet on which said visible image has been reproduced during the earlier cycle of copying operation, said paper recirculation means being operative to recirculate the copying sheet toward said image reproducing means during the later cycle of copying operation, and (c) means for detecting a difference between the number of copying sheets received by said paper recirculation means during said earlier cycle of copying operation and the number of copying sheets recirculated from said paper recirculation means during said later cycle of copying operation for producing a warning signal when said difference is detected upon completion of said two consecutive cycles of copying operation.

5. An image duplicating apparatus as set forth in claim 4, in which said mode of copying operation has an earlier cycle of operation to reproduce a visible image on any face of a copying sheet and a later cycle of operation to reproduce a visible image also on said face of the copying sheet.

6. An image duplicating apparatus as set forth in claim 4, in which said mode of copying operation has an earlier cycle of operation to reproduce a visible image on any face of a copying sheet and a later half cycle of operation to reproduce a visible image on the opposite face of the copying sheet.

7. An image duplicating apparatus having a mode of copying operation which includes two consecutive cycles, comprising (a) image reproducing means for reproducing on a copying sheet a visible image duplicated from an original image on a document sheet, (b) paper recirculation means for receiving from said image reproducing means the copying sheet on which said visible image has been reproduced during the earlier cycle of copying operation, said paper recirculation means being operative to recirculate the copying sheet toward said image reproducing means during the later cycle of copying operation, (c) means for detecting the number of copying sheets received by said paper recirculation means during said earlier cycle of copying operation and the number of copying sheets recirculated from said paper recirculation means during said later cycle of copying operation, and (d) means for discharging a copying sheet or sheets out of said paper recirculation means upon completion of said two consecutive cycles of copying operation when it is detected that the number of copying sheets received by said paper recirculation means during said earlier cycle of copying operation is larger than the number of copying sheets recirculated from said paper recirculation means during said later cycle of copying operation.

8. An image duplicating apparatus as set forth in claim 7, in which said mode of copying operation has an earlier cycle of operation to reproduce a visible image on any face of a copying sheet and a later cycle of operation to reproduce a visible image also on said face of the copying sheet.

9. An image duplicating apparatus as set forth in claim 7, in which said mode of copying operation has an earlier cycle of operation to reproduce a visible image on any face of a copying sheet and a later cycle of operation to reproduce a visible image on the opposite face of the copying sheet.

10. In an image duplicating apparatus having a mode of copying operation having two consecutive cycles, comprising image reproducing means for reproducing on a copying sheet a visible image duplicated from an original image on a document sheet, document setting/resetting means for automatically setting and resetting document sheets one after another to and from an exposure position enabling said image reproducing means to reproduce the visible image on a copying sheet, paper re-feeding means including an intermediate tray on which a copying sheet having said visible image reproduced by said image reproducing means is to be received from said image reproducing means during the earlier cycle of copying operation and is to be re-fed from the intermediate tray to the image reproducing means during the later cycle of copying operation, and control means for controlling said document setting/re-setting means to operate each time the two consecutive cycles of copying operation are complete for each copying sheet, a method comprising the steps of (a) setting a first document sheet in said exposure position by said document setting/resetting means, (b) successively feeding a plurality of copying sheets to said image reproducing means for reproducing the image on said first document sheet onto each of the plurality of copying sheets and thereafter successively feeding the copying sheets to said intermediate tray during the earlier cycle of copying operation, (c) re-setting the first document sheet from said exposure position and setting a second document sheet in said exposure position by said document setting/resetting means, (d) successively re-feeding the copying sheets from said intermediate tray to said image reproducing means by said paper re-feeding means for reproducing the image on said second document sheet onto each of the re-fed copying sheets, (e) detecting the difference between the number of copying sheets received by said intermediate tray during said earlier cycle of copying operation and the number of copying sheets re-fed from said intermediate tray during said later cycle of copying operation upon completion of said two consecutive cycles of copying operation for producing a signal when said difference is detected, and (f) disabling said document setting/re-setting means in response to said signal.

11. A method as set forth in claim 10 further comprising the step of (g) entering a numeral representing a desired number of copying sheets on which the image on said first document sheet is to be reproduced during the earlier cycle of copying operation.

12. In an image duplicating apparatus having a mode of copying operation having two consecutive cycles, comprising image reproducing means for reproducing on a copying sheet a visible image duplicated from an original image on a document sheet, document setting/resetting means for automatically setting and resetting document sheets one after another to and from an exposure position enabling said image reproducing means to reproduce the visible image on a copying sheet, paper re-feeding means including an intermediate tray on which a copying sheet having said visible image reproduced by said image reproducing means is to be received from said image reproducing means during the earlier cycle of copying operation and is to be re-fed from the intermediate tray to the image reproducing means during the later cycle of copying operation, and control means for controlling said document setting/re-setting means to operate each time the two consecutive cycles of copying operation are complete for each copying sheet, a method comprising the steps of (a) reproducing the image on a first document sheet onto each of a plurality of copying sheets and thereafter successively receiving the copying sheets on said intermediate tray during the earlier cycle of copying operation, (b) successively re-feeding the copying sheets from said intermediate tray to said image reproducing means by said paper re-feeding means for reproducing the image on a second document sheet onto each of the re-fed copying sheets, (c) detecting the difference between the number of copying sheets received by said intermediate tray during said earlier cycle of copying operation and the number of copying sheets re-fed from said intermediate tray during said later cycle of copying operation upon completion of said two consecutive cycles of copying operation for producing a warning signal when said difference is detected.

13. A method as set forth in claim 12, further comprising the step of (d) entering a numeral representing a desired number of copying sheets on which the image on said first document sheet is to be reproduced during the earlier cycle of copy operation.

14. In an image duplicating apparatus having a mode of copying operation having two consecutive cycles, comprising image reproducing means for reproducing on a copying sheet a visible image duplicated from an original image on a document sheet, document setting/re-setting means for automatically setting and resetting document sheets one after another to and from an exposure position enabling said image reproducing means to reproduce the visible image on a copying sheet, paper re-feeding means including an intermediate tray on which a copying sheet having said visible image reproduced by said image reproducing means is to be received from said image reproducing means during the earlier cycle of copying operation and is to be re-fed from the intermediate tray to the image reproducing means during the later cycle of copying operation, and control means for controlling said document setting/re-setting means to operate each time the two consecutive cycles of copying operation are complete for each copying sheet, a method comprising the steps of (a) reproducing the image on a first document sheet onto each of a plurality of copying sheets and thereafter successively receiving the copying sheets on said intermediate tray during the earlier cycle of copying operation, (b) successively re-feeding the copying sheets from said intermediate tray to said image reproducing means by said paper re-feeding means for reproducing the image on a second document sheet onto each of the re-fed copying sheets, (c) comparing the number of copying sheets received by said intermediate tray during said earlier cycle of copying operation with the number of copying sheets re-fed from said intermediate tray during said later cycle of copying operation upon completion of said two consecutive cycles of copying operation for producing a signal when it is found that the former number of copying sheets is larger than the latter number of copying sheets, and (d) discharging a copying sheet or copying sheets from said intermediate tray in response to said signal.

15. A method as set forth in claim 14, further comprising the step of (e) entering a numeral representing a desired number of copying sheets on which the image on said first document sheet is to be reproduced during the earlier cycle of copying operation.

16. In a image duplicating apparatus having a mode of copying operation having two consecutive cycles, comprising image reproducing means for reproducing on a copying sheet a visible image duplicated from an original image on a document sheet, document setting/re-setting means for automatically setting and re-setting document sheets one after another to and from a exposure position enabling said image reproducing means to reproduce the visible image on a copying sheet, paper re-feeding means including an intermediate tray on which a copying sheet having said visible image reproduced by said image reproducing means is to be received from said image reproducing means during the earlier cycle of copying operation and is to be re-fed from the intermediate tray to the image reproducing means during the later cycle of copying operation, and control means for controlling said document setting/re-setting means to operate each time the two consecutive cycles of copying operation are complete for each copying sheet, a method comprising the steps of (a) entering a desired numeral, (b) thereafter setting a first document sheet in said exposure position by said document setting/re-setting means, (c) successive feeding a plurality of copying sheets to said image reproducing means for reproducing the image on said first document sheet onto each of the plurality of copying sheets and thereafter successively feeding the copying sheets to said intermediate tray during the earlier cycle of copying operation, (d) re-setting the first document sheet from said exposure position and setting a second document sheet in said exposure position by said document setting/re-setting means, (e) successively re-feeding the copying sheets from said intermediate tray to said image reproducing means by said paper re-feeding means for reproducing the image on said second document sheet onto each of the re-fed copying sheets, (f) detecting the difference between the number of copying sheets received by said intermediate tray during said earlier cycle of copying operation and the number of copying sheets re-fed from said intermediate tray during said later cycle of copying operation upon completion of said two consecutive cycles of copying operation for producing a signal when said difference is detected, and (g) disabling said document setting/re-setting means in response to said signal.

17. In a image duplicating apparatus having a mode of copying operation having two consecutive cycles, comprising image reproducing means for reproducing on a copying sheet a visible image duplicated from an original image on a document sheet, document setting/re-setting means for automatically setting and re-setting document sheets one after another to and from a exposure position enabling said image reproducing means to reproduce the visible image on a copying sheet, paper re-feeding means including an intermediate tray on which a copying sheet having said visible image reproduced by said image reproducing means is to be received from said image reproducing means during the earlier cycle of copying operation and is to be re-fed from the intermediate tray to the image reproducing means during the later cycle of copying operation, and control means for controlling said document setting/re-setting means to operate each time the two consecutive cycles of copying operation are complete for each copying sheet, a method comprising the steps of (a) entering a desired numeral, (b) setting a first document sheet in said exposure position by said document setting/re-setting means, (c) successively feeding a plurality of copying sheets to said image reproducing means for reproducing the image on said first document sheet onto each of the plurality of copying sheets and thereafter successively feeding the copying sheets to said intermediate tray during the earlier cycle of copying operation, (d) re-setting the first document sheet from said exposure position and setting a second document sheet in said exposure position by said document setting/re-setting means, (e) successively re-feeding the copying sheets from said intermediate tray to said image reproducing means by said paper re-feeding means for reproducing the image on said second document sheet onto each of the re-fed copying sheets, (f) detecting the difference between the number of copying sheets received by said intermediate tray during said later cycle of copying operation and the number of copying sheets re-fed from said intermediate tray during said later cycle of copying operation upon completion of said two consecutive cycles of copying operation, and (g) producing a signal when said difference is detected.

18. In a image duplicating apparatus having a mode of copying operation having two consecutive cycles, comprising image reproducing means for reproducing on a copying sheet a visible image duplicated from an original image on a document sheet, document setting/re-setting means for automatically setting and re-setting document sheets one after another to and from a exposure position enabling said image reproducing means to reproduce the visible image on a copying sheet, paper re-feeding means including an intermediate tray on which a copying sheet having said visible image reproduced by said image reproducing means is to be received from said image reproducing means during the earlier cycle of copying operation and is to be re-fed from the intermediate tray to the image reproducing means during the later cycle of copying operation, and control means for controlling said document setting/re-setting means to operate each time the two consecutive cycles of copying operation are complete for each copying sheet, a method comprising the steps of (a) entering a desired numeral, (b) setting a first document sheet in said exposure position by said document setting/re-setting means, (c) successively feeding a plurality of copying sheets to said image reproducing means for reproducing the image on said first document sheet onto each of the plurality of copying sheets and thereafter successively feeding the copying sheets to said intermediate tray during the earlier cycle of copying operation, (d) re-setting the first document sheet from said exposure position and setting a second document sheet in said exposure position by said document setting/re-setting means, (e) successively re-feeding the copying sheets from said intermediate tray to said image reproducing means by said paper re-feeding means for reproducing the image on said second document sheet onto each of the re-fed copying sheets, (f) comparing the number of copying sheets received by said intermediate tray during said earlier cycle of copying operation with the number of copying sheets re-fed from said intermediate tray during said later cycle of copying operation upon completion of said two consecutive cycles of copying operation for producing a signal when it is found that the former number of copying sheets is larger than the latter number of copying sheets, and (g) discharging a copying sheet or copying sheets from said intermediate tray in response to said signal.

* * * * *

UNITED STATES PATENT AND TRADEMARK OFFICE

CERTIFICATE OF CORRECTION

PATENT NO. : 4,908,660

DATED : March 13, 1990

INVENTOR(S) : Ohira, et al.

It is certified that error appears in the above-identified patent and that said Letters Patent is hereby corrected as shown below:

Column 20, Claim 6, line 43, delete "half".

Signed and Sealed this

Thirteenth Day of July, 1993

*Attest:*

*Attesting Officer*

Michael K. Kirk

MICHAEL K. KIRK

*Acting Commissioner of Patents and Trademarks*